US005209635A

United States Patent [19]

Stewart et al.

[11] Patent Number: 5,209,635

[45] Date of Patent: May 11, 1993

[54] SLURRY PUMP

[75] Inventors: Ian Stewart; Robert Eaton; Maximillian A. Vella, all of Mount Isa, Australia

[73] Assignee: M.I.M. Holdings Limited, Australia

[21] Appl. No.: 763,468

[22] Filed: Sep. 23, 1991

[51] Int. Cl.[5] ..... F04D 29/08

[52] U.S. Cl. ..... 415/171.1; 415/170.1

[58] Field of Search ..... 415/170.1, 171.1

[56] References Cited

U.S. PATENT DOCUMENTS

| | | | |
|---|---|---|---|
| 1,556,657 | 10/1925 | Wilfley | 415/171.1 |
| 3,146,722 | 9/1964 | Warman | 415/206 |
| 3,535,051 | 10/1970 | Turner | 415/121.2 |
| 3,881,840 | 5/1975 | Bunjes | 415/171.1 |
| 4,527,947 | 7/1985 | Elliott | 415/171.1 |
| 4,664,592 | 5/1987 | Grzina | 415/171.1 |
| 4,854,820 | 8/1989 | Zolotar et al. | 415/171.1 |

FOREIGN PATENT DOCUMENTS

| | | | |
|---|---|---|---|
| 1062119 | 7/1959 | Fed. Rep. of Germany | 415/171.1 |

*Primary Examiner*—John T. Kwon

*Attorney, Agent, or Firm*—Stevens, Davis, Miller & Mosher

[57] ABSTRACT

An impeller for use in a centrifugal pump, the impeller including a plurality of vanes disposed intermediate a pair of spaced apart side walls, at least one of the side walls having a substantially smooth generally planar outer surface and a plurality of channels recessed into the surface, each of the channels spiralling progressively outwardly and rearwardly relative to an intended direction of rotation, and having a cross sectional flow area reducing substantially uniformly from a central region towards a respective rearwardly directed peripheral discharge port.

8 Claims, 2 Drawing Sheets

SLURRY PUMP

FIELD OF INVENTION

The present invention relates to pumps and in particular to a centrifugal pump for moving a fluid medium by accelerating the fluid radially outwardly in an impeller rotatably driven within a surrounding casing and discharging the fluid circumferentially at increased pressure.

The invention has been developed primarily for use with mineral slurry and will be described hereinafter with reference to this application. However, it will be appreciated that the invention is not limited to this particular field of use.

DESCRIPTION OF PRIOR ART

Centrifugal slurry pumps are known, and generally include an impeller having a number of curved vanes. The impeller is rotatably driven within a volute casing to accelerate the slurry radially, thereby producing an increase in pressure at the peripheral pump outlet. A problem encountered in pumping fluids of this nature is the rapid wear on pump components caused by the abrasive action of solid particles suspended in the slurry. This wear enlarges critical working clearances between adjacent components resulting in internal leakage of the fluid and giving rise to consequential reductions in delivery head and pumping efficiency. Worse still, this abrasive wear reduces the effective service life of expensive pump components such as the impeller, the throat bush, various liners and the housing itself, which significantly increases maintenance and running costs.

In an attempt to ameliorate these problems, it is known to provide external radially extending "pump-out" vanes projecting outwardly from each side of the impeller, in addition to the conventional internal vanes disposed within the impeller. The purpose of these external pump-out vanes is to accelerate and discharge radially any slurry in the clearances between the impeller and surrounding stationary components and to prevent the ingress of slurry into these clearances.

However, these known designs have generally not been effective in preventing the ingress of abrasive slurry into the side clearances between the impeller and the casing, and the consequential rapid component wear, loss in efficiency, and reduction in pump service life remain significant problems in pumps of this type.

It is therefore an object of the invention to provide an improved centrifugal pump which overcomes or substantially ameliorates at least some of these disadvantages.

SUMMARY

Accordingly, the present invention provides a centrifugal pump for mineral slurry, comprising a volute casing and an impeller adapted to be rotatably driven within the casing, said impeller including a pair of spaced apart side walls and a plurality of vanes disposed between the side walls whereby rotation of the impeller causes fluid within the casing to be accelerated radially and discharged circumferentially at increased pressure, at least one of said side walls having a generally planar outer surface adjacent the casing and a plurality of generally radially extending channels recessed into said surface, each said channel having a cross sectional flow area progressively reducing outwardly from a central region towards a peripheral discharge port.

Preferably, each said side wall includes a substantially smooth generally planar outer surface and a plurality of said channels recessed into said surface.

Preferably also, the recessed channels on at least one of the side walls extend radially outwardly from a central manifold region recessed into said surface and in fluid communication with each said channel.

In the preferred embodiment, the width of each channel reduces uniformly and progressively outwardly towards to the peripheral discharge port. Each channel preferably curves rearwardly with respect to the direction of rotation of the impeller.

The invention also includes within its scope an impeller for use in a centrifugal pump for mineral slurry, said impeller including a pair of spaced apart side walls and a plurality of vanes disposed between the side walls, at least one of said side walls having a generally planar outer surface and a plurality of generally radially extending channels recessed into said surface, each said channel having a cross sectional flow area progressively reducing outwardly from a central region towards a peripheral discharge port.

BRIEF DESCRIPTION OF DRAWINGS

A preferred embodiment of the invention will now be described, by way of example only, with reference to the accompanying drawings in which.

DESCRIPTION OF PREFERRED EMBODIMENT

Figure 1:
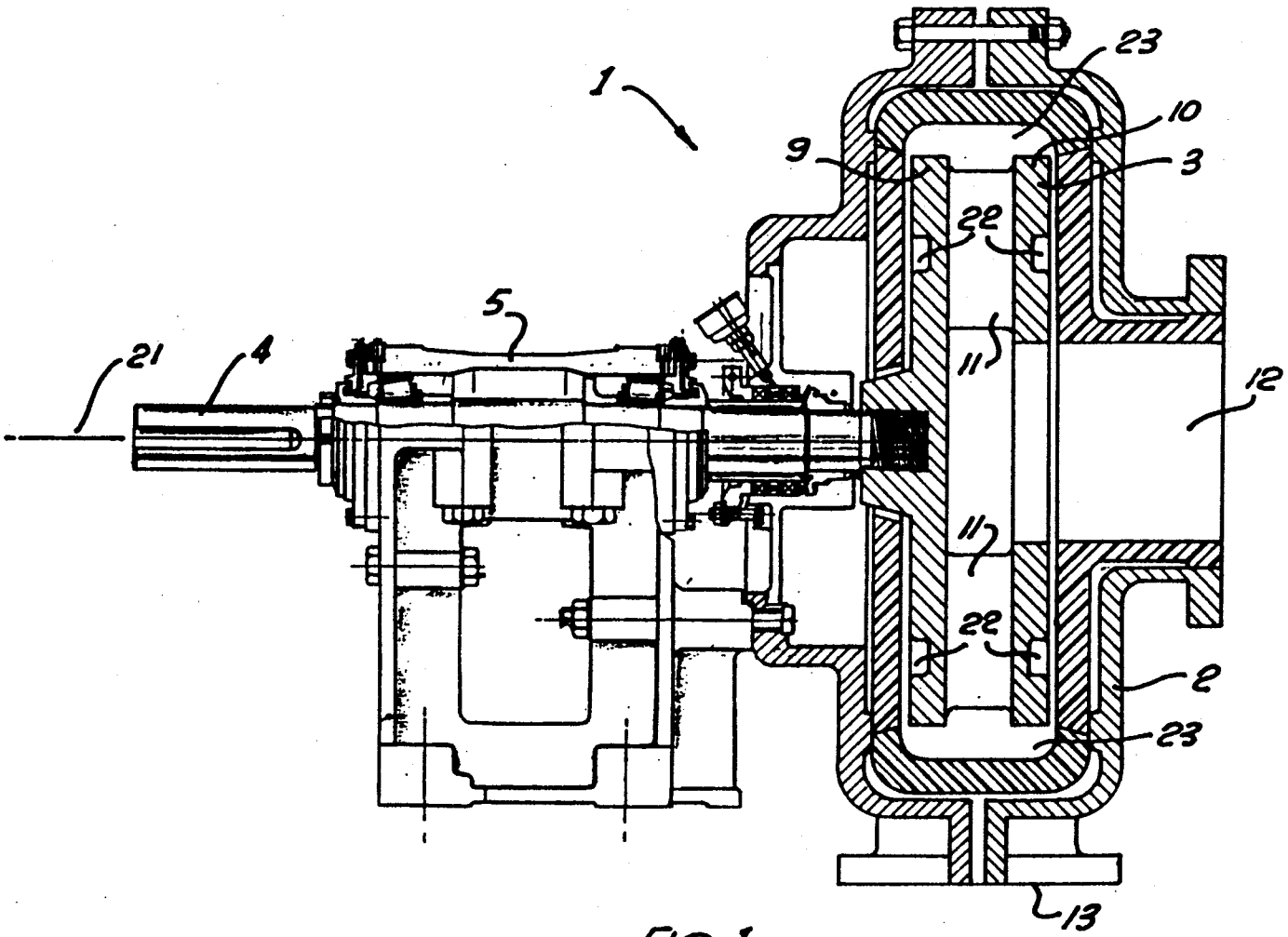
FIG. 1 is a cutaway sectional view showing a centrifugal pump according to the invention.

Referring to the drawings, the centrifugal slurry pump 1 includes a volute casing 2 and an impeller 3 adapted to be rotatably driven within the casing by means of input drive shaft 4 supported by bearing assembly 5. The impeller 3 includes spaced apart side walls 9 and 10 and a plurality of uniformly spaced internal curved vanes 11 disposed between the side walls. Rotation of the impeller causes slurry within the casing 2 to be accelerated radially from inlet region 12 and discharged circumferentially at increased pressure at pump outlet 13 in a manner well understood by those skilled in the art.

Figure 3:
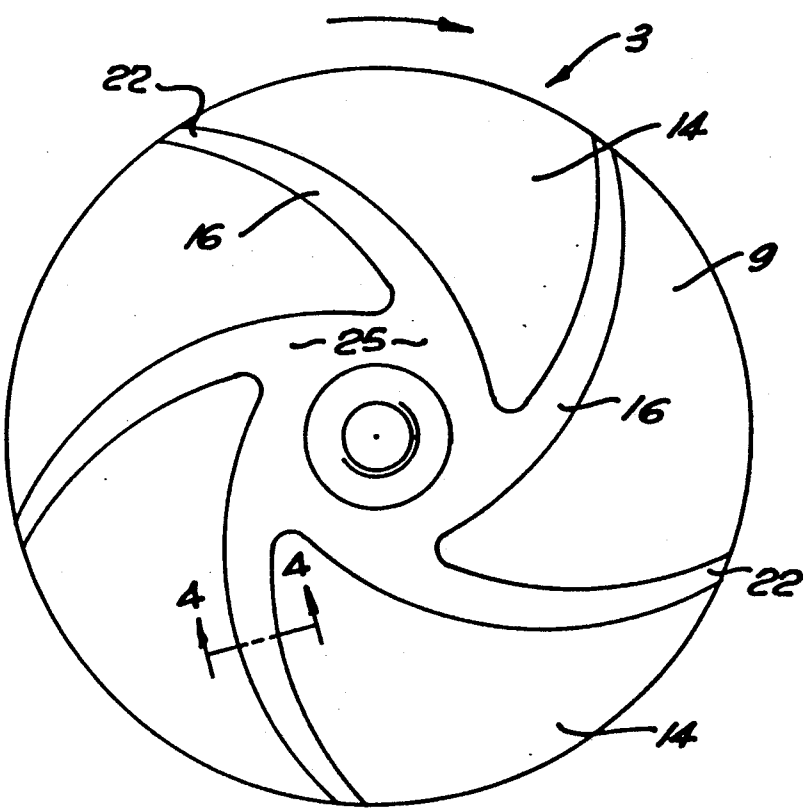
FIG. 3 is a rear elevation showing the impeller of FIG. 2.
Figure 4:
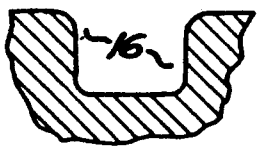
FIG. 4 is a sectional view taken along lines 4—4 of FIG. 2 or FIG. 3.
Figure 2:
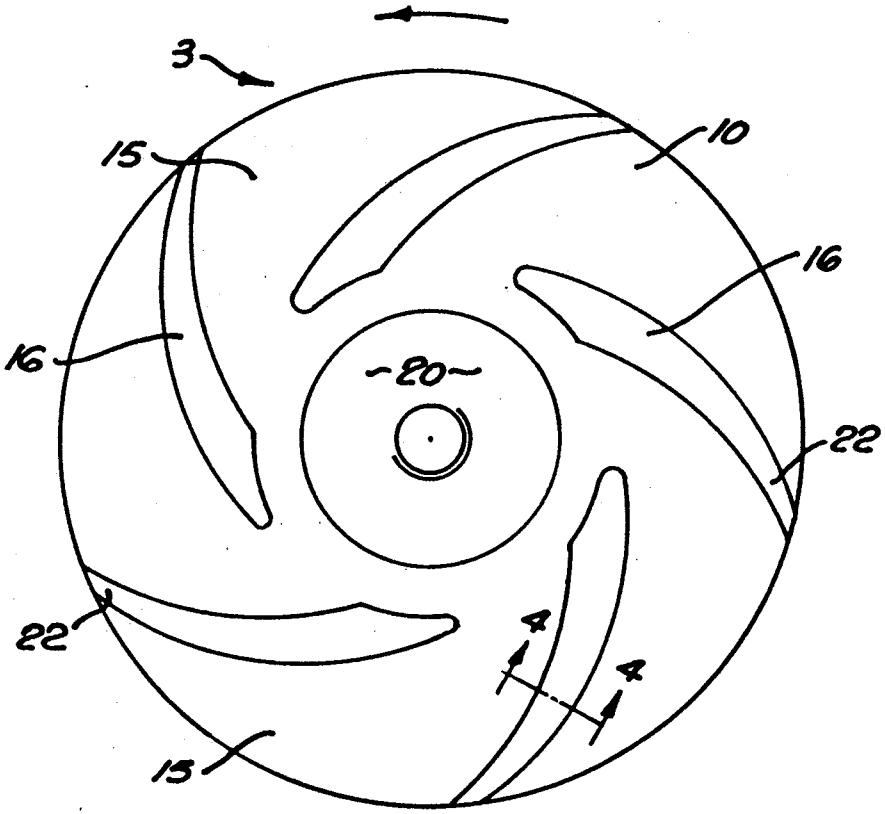
FIG. 2 is a front elevation showing the impeller of the pump of FIG. 1.

As best seen in FIGS. 2 and 3, the impeller side walls 9 and 10 have respective substantially smooth generally planar outer surfaces 14 and 15 adjacent corresponding inner walls of the casing 2 and a plurality of generally radially extending channels 16 recessed into the surfaces 14 and 15. Each channel 16 is curved rearwardly with respect to the direction of rotation of the impeller and is characterized by a cross-sectional flow area reducing progressively outwardly from a central region 20 adjacent the impeller axis 21 to a respective peripheral discharge port 22 in communication with circumferential annular discharge passage 23 defined between the impeller and the casing.

As best seen in FIG. 3, impeller side wall 9 includes a centrally disposed annular manifold region 25 recessed into outer surface 14 and in communication with each channel 16 on that surface. However, the channels on the opposite side of the impeller on surface 15 are preferably not centrally interconnected.

The invention flows from the realization that by providing the radial channels 16 recessed into the substantially smooth outer surfaces of the impeller, slurry can be effectively pumped from the clearance spaces defined between the impeller side walls and the casing, thereby significantly reducing component wear without the need for outwardly protruding pump-out vanes which have been found to induce turbulence and reduce the efficiency of the pump. This results in increased service life of wearing parts such as the shaft seal and throat bush, reduced power consumption, reduced operating and maintenance costs, and increased running efficiencies. Thus, the invention represents a significant improvement over the prior art.

It has also been found that these advantages can be enhanced by reducing the inlet diameter of the impeller in conjunction with a reduced eye throat bush. A reduced eye throat bush can also be used in conjunction with a standard eye impeller. In the preferred embodiment, a reduced eye impeller having an internal diameter of between 10 and 13 inches, and preferably 11 inches, is used as opposed to the conventional 14 inch standard eye design, which results in a significant increase in the effective service life of the impeller.

Although the invention has been described with reference to a specific example, it will be appreciated by those skilled in the art that the invention may be embodied in many other forms.

We claim:

1. An impeller for use in a centrifugal pump, said impeller including a plurality of vanes disposed intermediate a pair of spaced apart side walls, at least one of said side walls having a substantially smooth generally planar outer surface and a plurality of channels recessed into said surface, each said channel spiralling progressively outwardly and rearwardly relative to an intended direction of rotation and having a cross sectional flow area reducing substantially uniformly from a central region towards a respective rearwardly directed peripheral discharge port.

2. An impeller according to claim 1 wherein each said side wall includes a substantially smooth generally planar outer surface and a plurality of said recessed channels.

3. An impeller according to claim 2 wherein the channels associated with one of the side walls spiral outwardly from a centrally disposed manifold region recessed into said surface.

4. A centrifugal pump comprising a volute casing, an impeller mounted to be rotatably driven within the casing, an inlet disposed to direct fluid generally axially from a feed line to the impeller, and an outlet disposed to direct fluid generally circumferentially to a discharge line, such that rotation of the impeller causes fluid from the inlet to be accelerated radially within the casing and discharged circumferentially from the outlet at increased pressure, said impeller including a plurality of vanes disposed intermediate a pair of spaced apart side walls, at least one of said side walls having a substantially smooth generally planar outer surface and a plurality of channels recessed into said surface, each said channel spiralling progressively outwardly and rearwardly relative to an intended direction of rotation and having a cross sectional flow area reducing substantially uniformly from a central region towards a respective rearwardly directed peripheral discharge port.

5. A centrifugal pump according to claim 4 wherein the effective internal diameter of said inlet is substantially less than the nominal internal diameter of the feed line.

6. A centrifugal pump according to claim 5 wherein the effective internal diameter of the inlet is less than about 14 inches.

7. A centrifugal pump according to claim 6 wherein the effective internal diameter of the inlet is between 10 and around 13 inches.

8. A centrifugal pump according to claim 5 further including a reduced eye throat bush tapering progressively from the feed line to the impeller inlet to provide a smooth transition therebetween.

* * * * *